US011333475B2

(12) United States Patent
Kim et al.

(10) Patent No.: US 11,333,475 B2
(45) Date of Patent: May 17, 2022

(54) COMMUNICATION SYSTEM AND DETONATOR

(71) Applicant: HANWHA CORPORATION, Seoul (KR)

(72) Inventors: Se Ho Kim, Boeun-gun (KR); Jeong Ho Choi, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 198 days.

(21) Appl. No.: 16/627,486

(22) PCT Filed: Dec. 16, 2019

(86) PCT No.: PCT/KR2019/017766
§ 371 (c)(1),
(2) Date: Dec. 30, 2019

(87) PCT Pub. No.: WO2020/138798
PCT Pub. Date: Jul. 2, 2020

(65) Prior Publication Data

US 2021/0333076 A1 Oct. 28, 2021

(30) Foreign Application Priority Data

Dec. 28, 2018 (KR) ..... 10-2018-0172464

(51) Int. Cl.
*F42D 1/05* (2006.01)
*F42B 3/12* (2006.01)

(52) U.S. Cl.
CPC ..... *F42D 1/05* (2013.01); *F42B 3/122* (2013.01)

(58) Field of Classification Search
CPC .... F42D 1/05; F42B 3/122; F42B 3/18; F42B 3/188
USPC ..... 102/202.1, 206
See application file for complete search history.

(56) References Cited

U.S. PATENT DOCUMENTS 4,968,980 A * 11/1990 Schmucker ..... F42C 13/045 102/214
5,894,103 A * 4/1999 Shann ..... F42D 1/055 102/215
9,568,294 B2 * 2/2017 Morris ..... F42C 11/06
2016/0223310 A1 * 8/2016 Morris ..... F42C 13/06

FOREIGN PATENT DOCUMENTS

CA 2718581 C * 6/2018 ..... F42C 11/06
KR 10-2013-0129724 A 11/2013
WO 2007/085916 A1 8/2007

* cited by examiner

*Primary Examiner* — Bret Hayes
(74) *Attorney, Agent, or Firm* — WHDA, LLP

(57) ABSTRACT

A communication system includes a transmitter and a receiver connected through a cable. The transmitter transmits a first signal to the receiver using a voltage applied to the cable. A control circuit of the receiver receives the first signal and transmitting a second signal to the transmitter using a current flowing to the cable. A charging circuit of the receiver performs a charging operation by receiving the voltage through the cable and supplying a driving voltage to the control circuit. The control circuit includes a filter generating a second voltage by extracting a voltage within a reference range from a peak voltage of a first voltage and a voltage meter extracting the first signal by measuring the second voltage.

17 Claims, 7 Drawing Sheets

COMMUNICATION SYSTEM AND DETONATOR

TECHNICAL FIELD

The present invention relates to a communication system and a detonator and, more particularly, to a communication system and a detonator able to improve the reliability of communications by filtering a reference voltage input to a receiver (i.e. the detonator).

BACKGROUND ART

In general, explosives are used in engineering work, such as rock blasting for tunnel construction and the demolition of buildings. That is, a plurality of holes, into which explosives are to be inserted, is drilled corresponding to the sections of a blasting target, i.e. the object to be blasted. After an explosive is inserted into each of the drilled holes, the explosives are connected to a blasting system. The explosives are exploded by operating the blasting system, thereby blasting the blasting target.

Such a blasting system includes a detonator serving as an igniter to ignite an explosive and a blasting device providing power necessary for the actuation of the detonator and a command signal to the detonator. Here, the detonator of the blasting system is generally implemented as an electric detonator. The electric detonator is disposed on an explosive side, and a plurality of electric detonators is connected to a single blasting device.

Such electric detonators may have a structure in which a plurality of detonators connected to a blasting device is simultaneously activated to simultaneously detonate explosives, or a structure in which a plurality of detonators connected to a blasting device is set at different delay times to be sequentially activated to thus sequentially detonate explosives.

Although electric detonators simultaneously detonating a plurality of explosives have been used to date, electric detonators sequentially detonating a plurality of explosives are more commonly used at present. For example, blasting systems using such an electric detonator are disclosed in a plurality of documents, such as Korean Patent No. 10-1016538, Korean Patent No. 10-0665878, Korean Patent No. 10-0665880, Korean Patent No. 10-0733346, and Japanese Patent Application Publication No. 2005-520115.

DISCLOSURE

Technical Problem

Accordingly, the present invention has been made keeping in mind the above problems occurring in the prior art, and an objective of the present invention is to provide a communication system and a detonator able to improve the reliability of communications by filtering a reference voltage input to a receiver.

Technical Solution

In order to accomplish the above objective, according to embodiments of the present invention, provided is a communication system including a transmitter and a receiver connected through a cable. The transmitter may transmit a first signal to the receiver using a voltage applied to the cable. The receiver may include: a control circuit receiving the first signal and transmitting a second signal to the transmitter using a current flowing to the cable; and a charging circuit performing a charging operation by receiving the voltage through the cable and supplying a driving voltage to the control circuit. The control circuit may include: a filter generating a second voltage by extracting a voltage within a reference range from a peak voltage of a first voltage; and a voltage meter extracting the first signal by measuring the second voltage.

The control circuit may include: a controller generating a toggle signal to generate the second signal, in response to the first signal; and a control switch disposed on the cable to control the current flowing to the cable, in response to the toggle signal.

The filter may include a transistor connecting a first and a second electrode in response to the first voltage supplied to a gate electrode, the driving voltage may be supplied to the first electrode, and the second voltage may be output to the second electrode.

The second voltage may have a first voltage value while the first voltage has a peak voltage value. The second voltage may have a second voltage value, different from the first voltage value, while the first voltage has a base voltage value.

The driving voltage may have the first voltage value. The first voltage value may be greater than the second voltage value.

A difference between the first voltage value and the second voltage value may fall within the reference range.

The reference range may correspond to a gate/source voltage of the transistor.

The charging circuit may include: a charger performing the charging operation by receiving the first voltage supplied thereto; and a charging switch disposed between the charger and the cable to control a supply of the voltage to the charger, in response to a charge stop signal. The control circuit may transmit the charge stop signal to the charging switch while the second signal is transmitted.

In order to accomplish the above objective, according to embodiments of the present invention, provided is a detonator including: a control circuit receiving a first signal from a blasting device through a cable, the first signal being generated using a first voltage by a blasting device, and transmitting a second signal to the blasting device using a current flowing to the cable; and a charging circuit performing a charging operation by receiving the first voltage through the cable and supplying a driving voltage to the control circuit. The control circuit may include: a filter generating a second voltage by extracting a voltage within a reference range from a peak voltage of the first voltage; and a voltage meter extracting the first signal by measuring the second voltage.

The control circuit may include: a controller generating a toggle signal to generate the second signal in response to the first signal; and a control switch disposed on the cable to control the current flowing to the cable in response to the toggle signal.

The filter may include a transistor connecting a first and a second electrode in response to the first voltage supplied to a gate electrode. The driving voltage may be supplied to the first electrode. The second voltage may be output to the second electrode.

The second voltage may have a first voltage value during a period in which the first voltage has a peak voltage value. The second voltage may have a second voltage value different from the first voltage value during a period in which the first voltage has a base voltage value.

The driving voltage may have the first voltage value. The first voltage value may be greater than the second voltage value.

A difference between the first voltage value and the second voltage value may fall within a gate/source voltage of the transistor.

The charging circuit may include: a charger performing the charging operation by receiving the first voltage supplied thereto; and a charging switch disposed between the charger and the cable to control a supply of the voltage to the charger, in response to a charge stop signal. The control circuit may transmit the charge stop signal to the charging switch while the second signal is transmitted.

The detonator may further include an ignition circuit igniting under control of the control circuit.

The control circuit may provide a blasting signal and a blasting voltage to the ignition circuit by counting a delay time included in the first signal. The ignition circuit may apply the blasting voltage to a fuse head in accordance with the blasting signal.

Advantageous Effects

As described above, the communication system and the detonator according to embodiments of the present invention may improve the reliability of communications by filtering a reference voltage input to a receiver.

The advantages obtainable from the present invention are not limited to the aforementioned advantages, and other advantages not explicitly disclosed herein will be clearly understood by those skilled in the art to which the present invention pertains from the description provided hereinafter.

Figure 1:
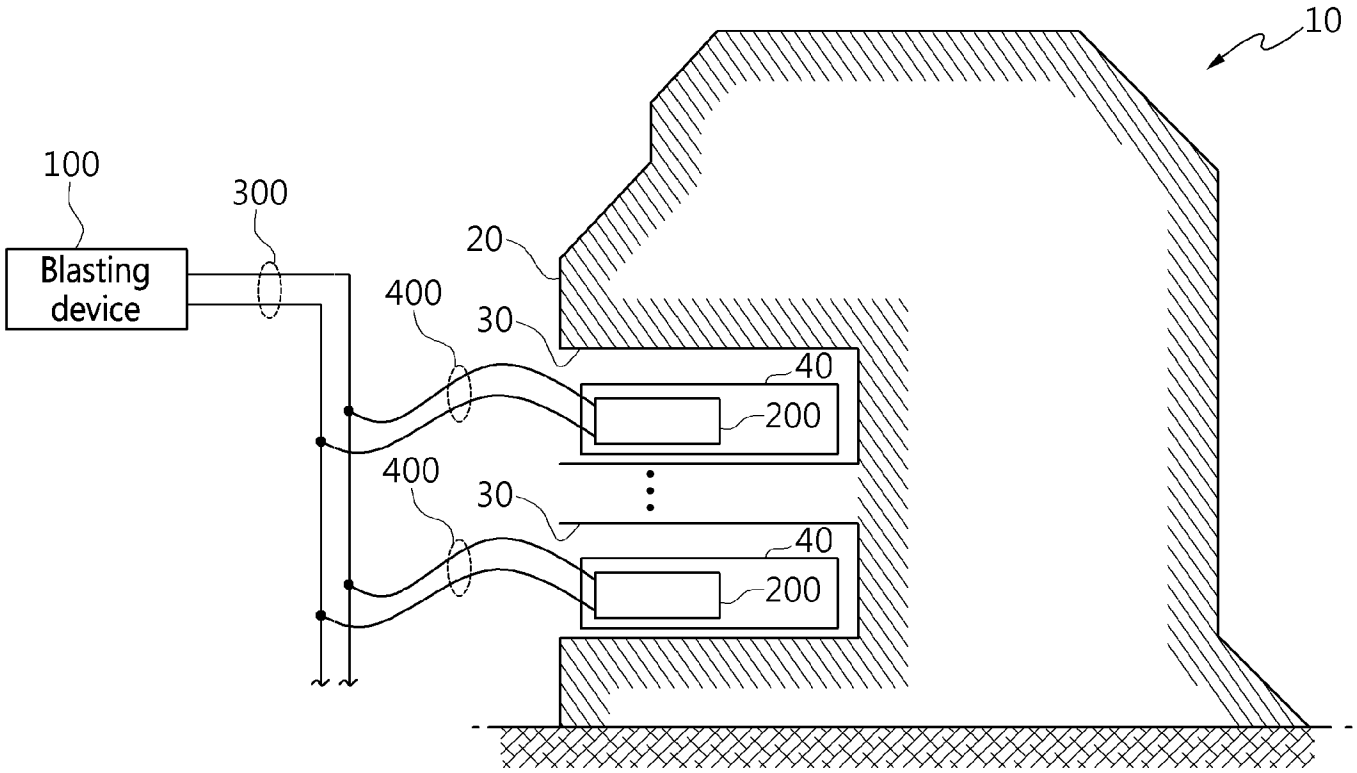
FIG. 1 is a conceptual view illustrating a blasting system according to embodiments of the present invention.

| [Description of the Reference Numerals in the Drawings] | |
|---|---|
| 10: blasting system | 20: blasting target |
| 30: blasting hole | 40: explosive |
| 100: blasting device | 110: blasting controller |
| 120: voltage supply | 130: current meter |
| 200: detonator | 210: charging circuit |
| 220: control circuit | 230: ignition circuit |

BEST MODE

Hereinafter, embodiments of the present invention and matters necessary for those skilled in the art to readily understand the features of the present invention will be described in detail with reference to the accompanying drawings. These embodiments are provided only for illustrative purposes, since the present invention may be implemented in a variety of different forms without departing from the scope of the present invention defined by the claims.

In the drawings, the same components will be designated by the same reference numerals. In addition, the thicknesses, ratios, and sizes of the components may be exaggerated for effective descriptions of technical features. The expression "and/or" includes any one or any combination of the mentioned items.

Terms such as "first" and "second" may be used herein to describe a variety of elements, and the elements should not be limited by the terms. The terms are only used to distinguish one element from other elements. Thus, a first element may be referred to as a second element, and similarly, a second element may be referred to as a first element. Singular forms used herein are intended to mean "one or more" unless the context clearly indicates otherwise.

Terms, such as "below", "beneath", "under", "lower", "above", and "upper", may be used herein for ease of description of the relationship of an element to other elements as illustrated in the drawings. Such terms should be construed as describing relative relationships, and are used with respect to the orientations depicted in the drawings.

It will be further understood that the terms "comprise", "include", "have", etc. when used in this specification, specify the presence of stated features, integers, steps, operations, components, parts, and/or combinations thereof, but do not preclude the presence or addition of one or more other features, integers, steps, operations, components, parts, and/or combinations thereof.

That is, the present disclosure is not limited to the embodiments disclosed below, and may be realized in various other forms. It will be understood that when an element is referred to as being "connected" to another element, not only can it be directly connected to the other element, but it can also be electrically connected to the other element via an intervening element. In designating elements of the drawings by reference numerals, the same elements will be designated by the same reference numerals even when they are shown in different drawings.

FIG. 1 is a conceptual view illustrating a blasting system 10 according to embodiments of the present invention.

Referring to FIG. 1, the blasting system 10 may include a blasting device 100, detonators 200, and cables 300 and 400.

Blasting operators may form blasting holes 30 by perforating a blasting target 20 in order to explode the blasting target 20. For example, blasting operators may form the blasting holes 30 in the blasting target 20 using a boring machine (not shown).

Blasting operators may insert explosives 40 into the blasting holes 30, with the explosives 40 having the respective detonators 200 attached thereto. For example, blasting operators may insert the explosives 40 having the detonators 200 attached thereto into the blasting holes 30 using a charging machine (not shown).

The blasting device 100 and the detonators 200 may be connected through a wired communication means including the cables 300 and 400. For example, blasting device 100 may be connected in parallel to a plurality of detonators 200 via the cables 300 and 400.

Here, the cables 300 and 400 may include main cables 300 and sub-cables 400. The main cables 300 may be electric wires directly connected to the blasting device 100, while the sub-cables 400 may be electric wires directly connected to the detonators 200. As a result, the main cables 300 and the sub-cables 400 may be connected, so that the blasting device 100 and the detonators 200 may be electrically connected for communications. In some embodiments, the cables 300 and 400 may be implemented as a two-line wired communication system.

A blasting operator may scan the detonators 200 using the operator's terminal device (e.g. a smartphone, a scanner, or a logger). For example, the blasting operator may scan the detonators 200 by capturing images of image codes (e.g. quick response (QR) codes or bar codes) attached to the detonators 200 or personally logging the image codes. The operator's terminal device may transmit detonator information and initialization information regarding each of the scanned detonators 200 to the blasting device 100.

The blasting device 100 may store the detonator information and the initialization information regarding each of the detonators 200 received from the operator's terminal device.

The operator may generate a first signal (e.g. a control signal or a blasting command) by operating the blasting device 100 in order to start blasting. In addition, the blasting device 100 may receive the first signal through the cables 300 and 400 on the basis of the above-described connection relationship.

In some embodiments, the first signal may be a blasting command including delay times corresponding to the respective detonators 200. The detonators 200 may start counting ignition start times included in the first signal. When the counting of the delay time is completed, the detonators 200 may detonate the explosives 40 connected thereto. Accordingly, the blasting device 100 may explode the blasting target by detonating the plurality of explosives 40.

Figure 2:
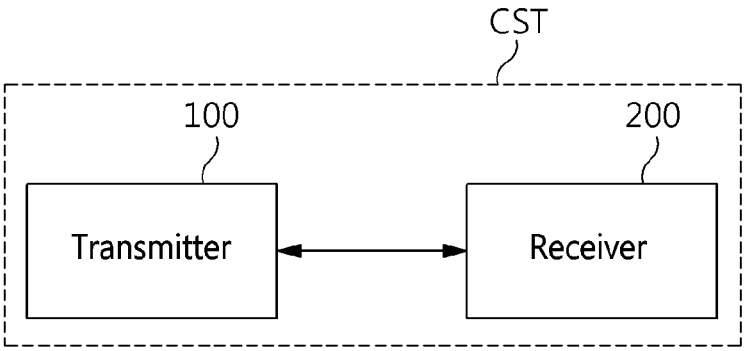
FIG. 2 is a block diagram illustrating a communication system according to embodiments of the present invention.

FIG. 2 is a block diagram illustrating a communication system according to embodiments of the present invention. Referring to FIG. 2, a communication system CST may include a transmitter 100 and a receiver 200.

In some embodiments, the communication system CST may be used in a blasting system, a fire alarm system, or the like. The communication system CST used in a blasting system will be representatively described in the specification. However, the present invention is not limited thereto, and the communication system CST used in the blasting system may be applied to different embodiments (e.g. a fire alarm system) while being easily modifiable by those skilled in the art.

For example, in the blasting system 10 illustrated in FIG. 1, the communication system CST may be a communication system between the blasting device 100 and the detonators 200. The transmitter 100 is a component corresponding to the blasting device 100 illustrated in FIG. 1. Herein, the transmitter 100 may be the blasting device 100. The receiver 200 is a component corresponding to each of the detonators 200 illustrated in FIG. 1. Herein, the receiver 200 may be the detonator 200.

The transmitter 100 may transmit a signal to the receiver 200 using a voltage, and the receiver 200 may transmit a signal to the transmitter 100 using a current. For example, the transmitter 100 and the receiver 200 may be connected to each other through the cables 300 and 400 (see FIG. 1). Here, the transmitter 100 may transmit a signal to the receiver 200 using a voltage of the cables 300 and 400 (i.e. reference voltage). The receiver 200 may receive the signal, transmitted by the transmitter 100, by measuring the voltages of the cables 300 and 400.

The receiver 200 may transmit a signal to the transmitter 100 in response to the signal received from the transmitter 100. Here, the receiver 200 may transmit the signal using the current flowing through the cables 300 and 400 (i.e. reference current). The transmitter 100 may receive the signal, transmitted by the receiver 200, by measuring the current flowing through the cables 300 and 400.

According to the above description, the communication system CST may carry out wired communications.

Figure 3:
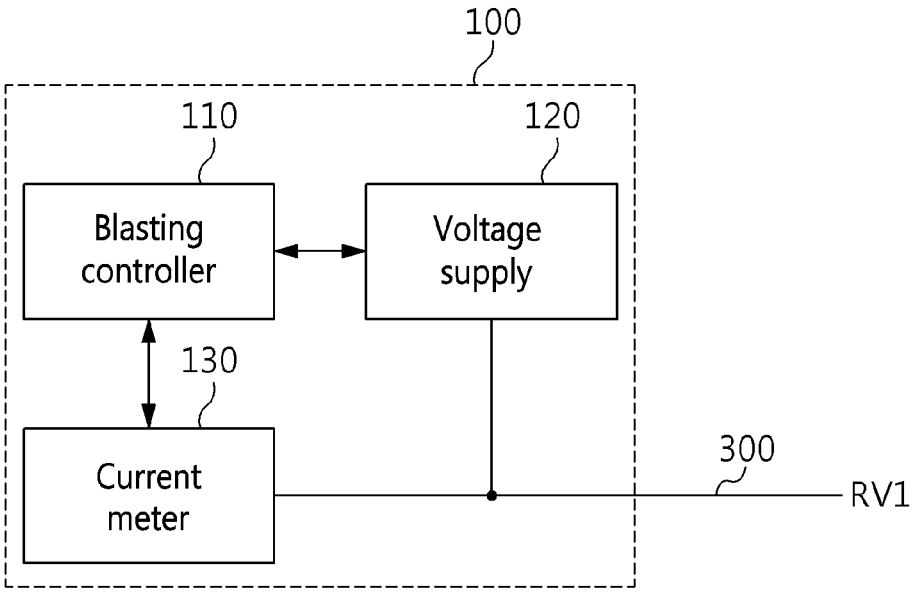
FIG. 3 is a diagram illustrating the blasting device according to embodiments of the present invention.

FIG. 3 is a diagram illustrating the blasting device 100 according to embodiments of the present invention.

Referring to FIG. 3, the blasting device 100 may include a blasting controller 110, a voltage supply 120, and a current meter 130.

For the sake of brevity, the main cable 300 connected to the blasting device 100 is illustrated as being a single wire in FIG. 3. However, the present invention is not limited thereto, and in some embodiments, the main cable 300 may be implemented as a plurality of electric wires.

The blasting controller 110 may control the overall operation of the blasting device 100. In some embodiments, the blasting controller 110 may be implemented as a central processing unit (CPU), a microprocessor unit (MPU), a graphics processing unit (GPU), a micro controller unit (MCU), or the like.

The voltage supply 120 may operate under the control of the blasting controller 110. Specifically, the voltage supply 120 may supply a voltage to the main cable 300. For example, the voltage supply 120 may supply a first reference voltage RV1 to the main cable 300.

In some embodiments, the first reference voltage RV1 may range from 0V to 100V. However, the present invention is not limited thereto, and the first reference voltage RV1 may have a variety of values, as long as the objective of the present invention can be realized.

Although not shown in FIG. 3, in some embodiments, the voltage supply may supply the first reference voltage RV1 and a ground voltage (e.g. 0V) to the main cable 300, which is comprised of a plurality of electric wires.

The voltage supply 120 may not only supply power, but may also transmit a signal, data, and the like, to the detonator 200 (see FIG. 1) using the first reference voltage RV1. For example, the voltage supply 120 may provide a pulse signal to the main cables 300 using the first reference voltage RV1, and the detonator 200 may detect the pulse signal provided through the sub-cables 400 (see FIG. 1) connected to the main cables 300. In this manner, the voltage supply 120 may transmit a signal, data, and the like to the detonator 200.

The current meter 130 may operate under the control of the blasting controller 110. Specifically, the current meter 130 may measure the current flowing to the main cables 300. The current meter 130 may receive a signal, data, and the like from the detonator 200 by measuring the current flowing through the main cables 300. For example, the detonator may control the flow of the reference current supplied to the main cables 300 and the sub-cables 400, and the current meter 130 may measure the reference current.

Although the blasting controller 110, the voltage supply 120, and the current meter 130 are illustrated as being separate components in FIG. 3, the present invention is not limited thereto. In some embodiments, at least some of the blasting controller 110, the voltage supply 120, and the current meter 130 may be integrated.

Although not shown in FIG. 3, in some embodiments, the detonator 100 may further include other components, such as a battery for supplying driving power to the detonator 100, a display panel to display the operating state of the detonator 100, and the like.

Figure 4:
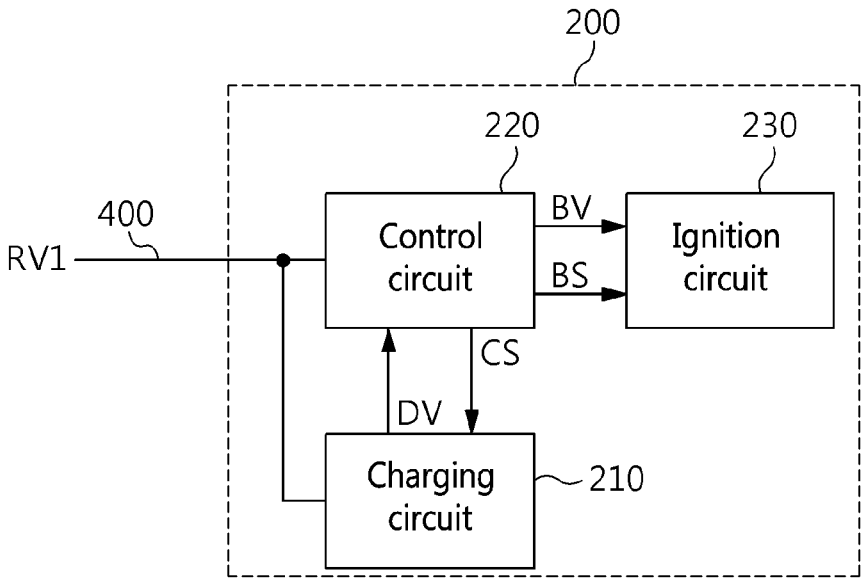
FIG. 4 is a diagram illustrating the detonator according to embodiments of the present invention.

FIG. 4 is a diagram illustrating the detonator 200 according to embodiments of the present invention.

Referring to FIG. 4, the detonator 200 may include a charging circuit 210, a control circuit 220, and an ignition circuit 230.

For the sake of brevity, the sub-cable 400 connected to the detonator 200 is illustrated as being a single wire in FIG. 4. However, the present invention is not limited thereto, and in some embodiments, the sub-cable 400 may be implemented as a plurality of electric wires.

The charging circuit 210 may receive the first reference voltage RV1 from the blasting device 100 (see FIG. 1) through the sub-cable 400.

The charging circuit 210 may receive a charge stop signal CS from the control circuit 220. The charging circuit 210 may perform a charging operation using the first reference voltage RV1 in response to the charge stop signal CS. For example, the charging circuit 210 may stop the charging operation using the first reference voltage RV1 while the charge stop signal CS is provided.

That is, when the charging circuit 210 performs the charging operation using the first reference voltage RV1, a background current may be produced in the detonator 200 by the charging operation. The background current may reduce variation in the current when the control circuit 220 transmits a second signal to the blasting device, thereby reducing the accuracy of signal analysis. Accordingly, the control circuit 220 may reduce the background current by transmitting the charge stop signal CS to the charging circuit 210 while transmitting the second signal to the blasting device 100. In addition, the control circuit may improve the accuracy of signal analysis by increasing the variation in the current.

The charging circuit 210 may supply a driving voltage DV to the control circuit 220 on the basis of the charged voltage. Here, the control circuit 220 may be operated on the basis of the driving voltage DV.

The control circuit 220 may receive the first reference voltage RV1 from the blasting device 100 through the sub-cable 400. Although not shown, the control circuit 220 may receive the ground voltage (e.g. 0V) through an additional electric wire.

The control circuit 220 may receive a first signal from the blasting device 100 through the cables 300 and 400. The first signal may be a pulse signal based on the first reference voltage RV1 applied to the cables 300 and 400 by the blasting device 100.

Here, the control circuit 220 may filter noise from the first reference voltage RV1. For example, the control circuit 220 may filter noise from a base voltage of the first reference voltage RV1 by extracting a voltage within a predetermined range from a peak voltage of the first reference voltage RV1. Details with regard thereto will be described later with reference to FIG. 8.

The control circuit 220 may transmit a second signal to the blasting device 100 through the cables 300 and 400, in response to the first signal. The second signal may be a pulse signal based on the reference signal.

The control circuit 220 may provide the charge stop signal CS to the charging circuit 210 while transmitting the second signal to the blasting device 100. While the charge stop signal CS is provided, the charging circuit 210 may stop the charging operation using the first reference voltage RV1.

In some embodiments, the first signal may be a blasting command including a delay time. Here, the control circuit 220 may count the delay time included in the first signal. When the counting of the delay time is completed, the control circuit 220 may generate a blasting signal BS and transmit the blasting signal BS to the ignition circuit 230. In addition, the control circuit 220 may generate a blasting voltage BV on the basis of at least one of the driving voltage DV and the first reference voltage RV1. The control circuit 220 may provide the blasting voltage BV to the ignition circuit 230.

The ignition circuit 230 may supply the blasting voltage BV to a fuse head 234 in response to the blasting signal BS. The fuse head 234 may ignite when the blasting voltage BV is supplied thereto.

Although not shown in FIG. 3, in some embodiments, the detonator 200 may further include a protection circuit to protect internal circuit components from the voltages supplied through the cables 300 and 400.

Figure 5:
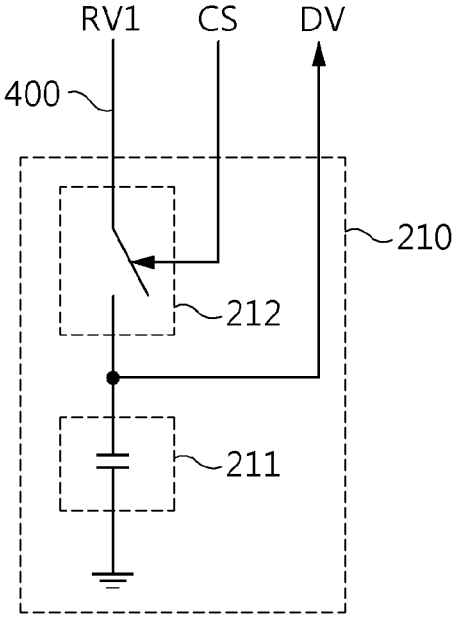
FIG. 5 is a diagram illustrating the charging circuit according to embodiments of the present invention.

FIG. 5 is a diagram illustrating the charging circuit 210 according to embodiments of the present invention.

Referring to FIG. 5, the charging circuit 210 may include a charger 211 and a charging switch 212.

The charger 211 may perform the charging operation by receiving the first reference voltage RV1 supplied through the sub-cable 400. The charger 211 may supply the driving voltage DV to the control circuit 220 (see FIG. 2), on the basis of the first reference voltage RV1. For example, the charger 211 may include a capacitor charging the first reference voltage RV1.

The charging switch 212 may be disposed between the first sub-cable 40 of the cables 300 and 400 and the charger 211. The charging switch 212 may control the supply of the first reference voltage RV1 to the charger 211 in response to the charge stop signal CS. For example, the charging switch 212 may include a switch that is turned off while the charge stop signal CS is provided. In some embodiments, the charging switch 212 may be implemented as a P-channel field effect transistor (FET).

Figure 6:
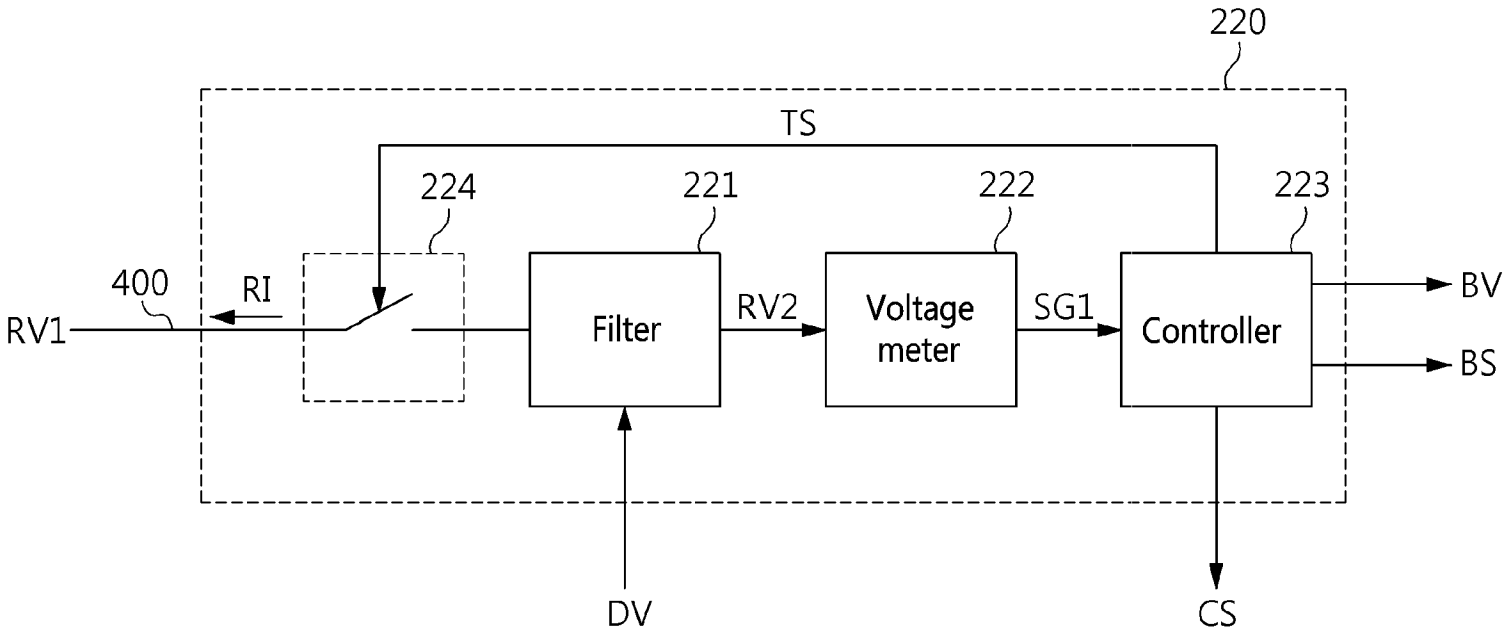
FIG. 6 is a diagram illustrating the control circuit according to embodiments of the present invention.

FIG. 6 is a diagram illustrating the control circuit 220 according to embodiments of the present invention.

Referring to FIG. 6, the control circuit 220 may include a filter 221, a voltage meter 222, a controller 223, and a control switch 224.

The filter 221 may filter the first reference voltage RV1 supplied to the sub-cable 400. For example, the filter 221 may filter noise from the base voltage of the first reference voltage RV1 by extracting a voltage within a predetermined range from the peak voltage of the first reference voltage RV1. Herein, the voltage filtered by the filter 221 as described above will be defined as a second reference voltage RV2. That is, the filter 221 may generate the second reference voltage RV2 by filtering the first reference voltage RV1. The filter 221 may supply the second reference voltage RV2 to the voltage meter 222.

The voltage meter 222 may measure the second reference voltage RV2. The voltage meter 222 may extract a first signal SG1 on the basis of the result of measurement of the voltage. The voltage meter 222 may transmit the first signal SG1 to the controller 223.

The controller 223 may receive the first signal SG1. The controller 223 may generate a toggle signal TS to generate a second signal in response to the first signal SG1. For example, the controller 223 may control the operation of the control switch 224 by transmitting the toggle signal TS to the control switch 224. The flow of reference current RI may be adjusted depending on the operation of the control switch 224. The second signal may be a pulse signal based on the reference current RI, and the controller 223 may generate the second signal using the toggle signal TS. Here, the reference current RI may be the current flowing from the detonator 200 to the blasting device 100 through the cables 300 and 400.

The control switch 224 may be disposed on the cables 300 and 400. In some embodiments, the control switch 224 may be disposed between the sub-cables 400 and the filter 221.

The control switch 224 may control the flow of the reference current RI in response to the toggle signal TS. For example, the control switch 224 may include a switch that is turned off while the toggle signal TS is provided. In some embodiments, the control switch 224 may be implemented as a P-channel FET.

The controller 223 may transmit the charge signal CS to the charging circuit 210 (see FIG. 3) while transmitting the second signal. In addition, the controller 223 may receive the driving voltage DV from the charging circuit 210.

In some embodiments, the first signal may be a blasting command including a delay time. Here, the controller 223 may count the delay time included in the first signal. When the counting of the delay time is completed, the controller 223 may generate the blasting signal BS, and may transmit the blasting signal BS to the ignition circuit 230. The controller 223 may generate the blasting voltage BV on the basis of at least one of the driving voltage DV and the first reference voltage RV1. In addition, the controller 223 may supply the blasting voltage BV to the ignition circuit 230 (see FIG. 3).

Figure 7:
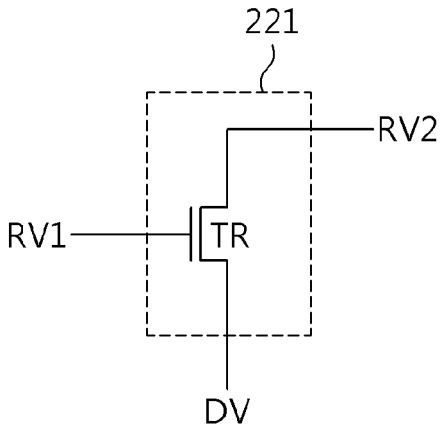
FIG. 7 is a diagram illustrating the filter according to embodiments of the present invention.
Figure 8:
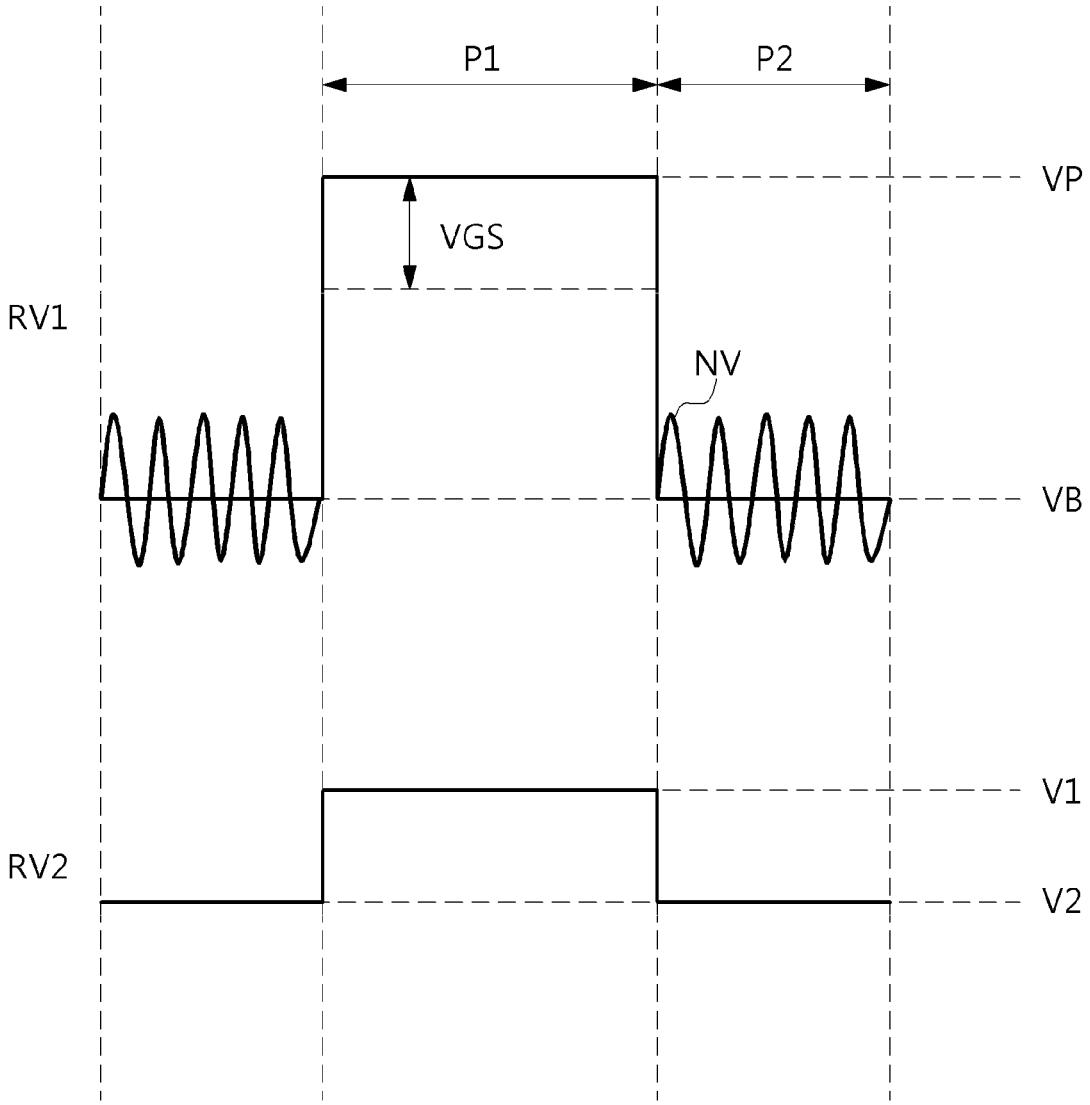
FIG. 8 is a diagram illustrating a first reference voltage and a second reference voltage according to embodiments of the present invention.

FIG. 7 is a diagram illustrating the filter 221 according to embodiments of the present invention. FIG. 8 is a diagram illustrating a first reference voltage RV1 and a second reference voltage RV2 according to embodiments of the present invention.

Referring to FIGS. 7 and 8, the filter 221 may include a transistor TR. In some embodiments, the transistor TR may be implemented as an N-channel or P-channel metal oxide semiconductor field-effect transistor (MOSFET). Herein, an embodiment in which the transistor TR is an N-channel transistor will be representatively described. However, the present invention is not limited thereto.

The filter 221 may filter the first reference voltage RV1. For example, the filter 221 may filter noise from the base voltage of the first reference voltage RV1 by extracting a voltage within a reference range VGS from the peak of the first reference voltage RV1. In some embodiments, the reference range VGS may be a predetermined value corresponding to a gate-source voltage of the transistor TR. Details with regard thereto will be described as follows.

The first reference voltage RV1 may be supplied to the gate electrode of the transistor TR. The driving voltage DV may be supplied to a first electrode of the transistor TR. The second reference voltage RV2 may be output to a second electrode of the transistor TR. The transistor TR may connect the first electrode and the second electrode, depending on the first reference voltage RV1. In some embodiments, each of the first electrode and the second electrode may be one of a source electrode and a drain electrode of the transistor.

As illustrated in FIG. 8, the first reference voltage RV1 may have a peak voltage value VP corresponding to the peak voltage and a base voltage value VB corresponding to the base voltage. A noise voltage NV may be included in the base voltage of the first reference voltage RV1, while the first reference voltage RV1 has the base voltage value VB.

During the first period P1, the first reference voltage RV1 may have the peak voltage value VP. When the first reference voltage RV1 having the peak voltage value VP is supplied to the gate electrode of the transistor TR, the transistor TR may be turned off. Accordingly, the second reference voltage RV2 corresponding to the driving voltage DV supplied to the first electrode is output to the second electrode. During the first period P1, the second reference voltage RV2 may have a first voltage value V1. In some embodiments, the driving voltage DV may have the first voltage value V1.

During the second period P2, the first reference voltage RV1 may have the base voltage value VB. When the first reference voltage RV1 having the base voltage value VB is supplied to the gate electrode of the transistor TR1, the transistor TR may be turned off. Accordingly, during the second period P2, the second reference voltage RV2 may have a second voltage value V2 different from the first voltage value V1. In some embodiments, the second voltage value V2 may be a ground voltage value. Here, the difference between the first voltage value V1 and the second voltage value V2 may fall within the reference range VGS.

As a result, the filter 221 may extract a voltage within the reference range VGS from the peak of the first reference voltage RV1, and may filter noise from the base voltage of the first reference voltage RV1. In addition, the filter 221 may output the extracted second reference voltage RV2. The detonator 200 according to embodiments of the present invention can improve the reliability of signal analysis by filtering the above-described noise voltage NV.

In some embodiments, the filter 221 may further include an output buffer connected to the second electrode of the transistor TR to receive and amplify the second reference voltage RV2.

Figure 9:
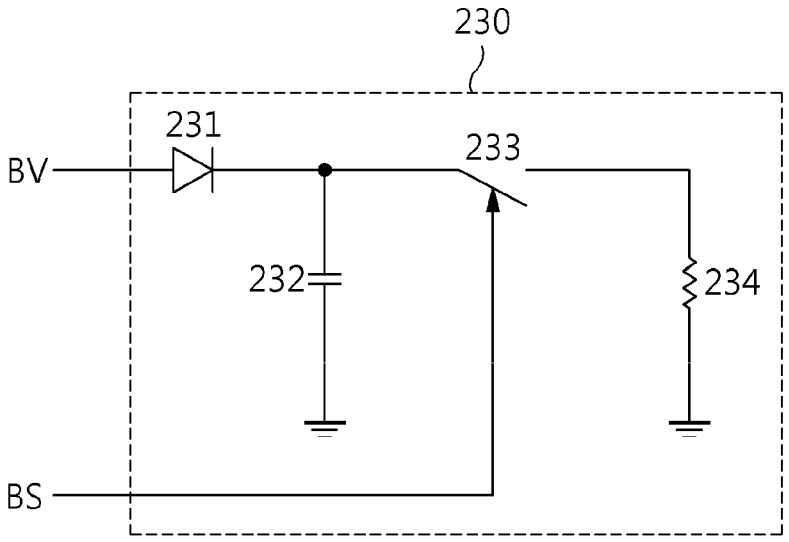
FIG. 9 is a diagram illustrating the ignition circuit according to embodiments of the present invention.

FIG. 9 is a diagram illustrating the ignition circuit 230 according to embodiments of the present invention.

Referring to FIG. 9, the ignition circuit 230 may include an ignition diode 231, an ignition capacitor 232, an ignition switch 233, and the fuse head 234.

The blasting voltage BV may be supplied to the ignition capacitor 232 through the ignition diode 231.

The ignition capacitor 232 may store the blasting voltage BV therein.

The ignition switch 233 may receive the blasting signal BS. The ignition switch 233 may be turned on while the blasting signal BS is provided. When the ignition switch 233 is turned on, the blasting voltage BV stored in the ignition capacitor 232 may be supplied to the fuse head 234. Since the blasting signal BS is provided to the ignition switch 233 after the delay time is counted, the fuse head 234 may receive the blasting voltage BV after the delay time is terminated.

As illustrated in FIG. 9, the fuse head 234 may have a unique resistance value. Accordingly, a voltage proportional to the unique resistance value may be applied to the fuse head 234. The fuse head 234 may ignite when the voltage is applied thereto.

As set forth above, the communication system and the detonator according to embodiments of the present invention can improve the reliability of communications and signal analysis by filtering the reference voltage input to the receiver.

Although the exemplary embodiments of the present invention have been described for illustrative purposes, those skilled in the art or those having ordinary knowledge in the art will appreciate that various modifications, additions and substitutions are possible without departing from the scope and spirit of the present invention as disclosed in the accompanying claims.

Therefore, the technical scope of the present invention is not limited to the exemplary embodiments described herein, but should be determined on the basis of the claims.

The invention claimed is:

1. A communication system comprising a transmitter and a receiver connected through a cable, wherein the transmitter transmits a first signal to the receiver using a first voltage applied to the cable, and the receiver includes:

a control circuit receiving the first signal and transmitting a second signal to the transmitter using a current flowing to the cable; and a charging circuit performing a charging operation by receiving the first voltage through the cable and supplying a driving voltage to the control circuit, wherein the control circuit includes:

a filter filtering a noise of the first voltage applied to the cable by extracting a second voltage within a reference range from a peak value of the first voltage; and a voltage meter extracting the first signal by measuring the second voltage.

2. The communication system according to claim 1, wherein the control circuit includes:

a controller generating a toggle signal to generate the second signal, in response to the first signal; and a control switch disposed on the cable to control the current flowing to the cable, in response to the toggle signal.

3. The communication system according to claim 1, wherein the filter includes a transistor connecting a first and a second electrode in response to the first voltage supplied to a gate electrode, the driving voltage is supplied to the first electrode, and the second voltage is output to the second electrode.

4. The communication system according to claim 3, wherein the second voltage has a first voltage value while the first voltage has the peak value, and the second voltage has a second voltage value, different from the first voltage value, while the first voltage has a base voltage value.

5. The communication system according to claim 4, wherein the driving voltage has the first voltage value, and the first voltage value is greater than the second voltage value.

6. The communication system according to claim 5, wherein a difference between the first voltage value and the second voltage value falls within the reference range.

7. The communication system according to claim 5, wherein the reference range corresponds to a gate/source voltage of the transistor.

8. The communication system according to claim 1, wherein the charging circuit includes:

a charger performing the charging operation by receiving the first voltage supplied thereto; and a charging switch disposed between the charger and the cable to control a supply of the voltage to the charger, in response to a charge stop signal, wherein the control circuit transmits the charge stop signal to the charging switch while the second signal is transmitted.

9. A detonator comprising:

a control circuit receiving a first signal from a blasting device through a cable, the first signal being generated using a first voltage by the blasting device, and transmitting a second signal to the blasting device using a current flowing to the cable; and a charging circuit performing a charging operation by receiving the first voltage through the cable and supplying a driving voltage to the control circuit, wherein the control circuit includes:

a filter filtering a noise of the first voltage applied to the cable by extracting a second voltage within a reference range from a peak value of the first voltage; and a voltage meter extracting the first signal by measuring the second voltage.

10. The detonator according to claim 9, wherein the control circuit includes:

a controller generating a toggle signal to generate the second signal in response to the first signal; and a control switch disposed on the cable to control the current flowing to the cable in response to the toggle signal.

11. The detonator according to claim 9, wherein the filter includes a transistor connecting a first and a second electrode in response to the first voltage supplied to a gate electrode, the driving voltage is supplied to the first electrode, and the second voltage is output to the second electrode.

12. The detonator according to claim 11, wherein the second voltage has a first voltage value during a period in which the first voltage has the peak value, and the second voltage has a second voltage value different from the first voltage value during a period in which the first voltage has a base voltage value.

13. The detonator according to claim 12, wherein the driving voltage has the first voltage value, and the first voltage value is greater than the second voltage value.

14. The detonator according to claim 13, wherein a difference between the first voltage value and the second voltage value falls within a gate/source voltage of the transistor.

15. The detonator according to claim 9, wherein the charging circuit includes:

a charger performing the charging operation by receiving the first voltage supplied thereto; and a charging switch disposed between the charger and the cable to control a supply of the voltage to the charger, in response to a charge stop signal, wherein the control circuit transmits the charge stop signal to the charging switch while the second signal is transmitted.

16. The detonator according to claim 9, further comprising an ignition circuit igniting under control of the control circuit.

17. The detonator according to claim 16, wherein the control circuit provides a blasting signal and a blasting voltage to the ignition circuit by counting a delay time included in the first signal, and the ignition circuit applies the blasting voltage to a fuse head in accordance with the blasting signal.

* * * * *